United States Patent [19]

Mazzanti

[11] 4,341,283

[45] Jul. 27, 1982

[54] SOUND SUPPRESSION SYSTEM

[76] Inventor: Vincent E. Mazzanti, 1020 Prospect St., Suite 312, La Jolla, Calif. 92037

[21] Appl. No.: 197,080

[22] Filed: Oct. 15, 1980

[51] Int. Cl.[3] ..... F41C 21/18; F01N 1/08; F01N 1/16; F01N 7/08

[52] U.S. Cl. ..... 181/223; 181/228; 181/238; 181/241; 181/271; 181/272; 181/275

[58] Field of Search ..... 181/223, 228, 238–239, 181/241, 251, 253–254, 268, 271–272, 275; 89/31

[56] References Cited

U.S. PATENT DOCUMENTS

| | | | |
|---|---|---|---|
| 832,695 | 10/1905 | Nygaard | 181/223 |
| 1,259,251 | 3/1918 | Love | 181/223 |
| 3,667,570 | 6/1972 | Wer Bell | 181/223 |

FOREIGN PATENT DOCUMENTS

| | | | |
|---|---|---|---|
| 545767 | 10/1922 | France | 181/275 |
| 181061 | 11/1935 | Switzerland | 181/268 |

*Primary Examiner*—L. T. Hix
*Assistant Examiner*—Thomas H. Tarcza
*Attorney, Agent, or Firm*—Charles C. Logan, II

[57] ABSTRACT

A sound suppression system having a sound suppression chamber formed from a longitudinally extending tubular housing. One end of the tubular housing is closed by an end plug which has a bore through which passes one end of a tubular member. The tubular member comprises a gun barrel having a cylindrical sleeve surrounding a predetermined length of the gun barrel. The tubular member has a plurality of tubular passages each of which have their one end in communication with the bore of the gun barrel and their other end longitudinally displaced therefrom adjacent the end of the gun barrel to place them in communication with the interior of the sound suppression chamber. A baffle having a cylindrical body approximating the interior diameter of the tubular housing is positioned within the tubular housing. Both the interior of the tubular housing and the outer cylindrical housing of the baffle are threaded so that the baffle may be adjustably positioned through the length of the tubular housing. The baffle has a bore which is aligned with the bore of the gun barrel to allow a bullet to pass therethrough. The end of the baffle adjacent the end of the gun barrel has a conical or convex gas deflection surface that is positioned in alignment with the ends of the tubular passages where they exit the tubular member. The outer end of the tubular housing has an end plug closing it and likewise has a bore in its center axially aligned with the bore of the gun barrel.

7 Claims, 5 Drawing Figures

SOUND SUPPRESSION SYSTEM

BACKGROUND OF THE INVENTION

The invention relates to a sound suppression system and more specifically to a sound suppression system that would be used with a gun or with an internal combustion engine such as used on a lawnmower.

In the past sound suppression systems have been designed to be used with guns but most of these have involved a highly complicated structure to manufacture. Also these previous sound suppression systems have not been entirely satisfactory in muffling the sound caused by the explosion when the bullet is fired. Previous sound suppression systems for guns also did not have built into them the capability for varying the position of the baffles within the sound suppression chamber in order to vary the degree to which the sound is muffled.

It is an object of the invention to provide a novel sound suppression system that can be used on a gun.

It is also an object of the invention to provide a novel sound suppression system that can be used in conjunction with an internal combustion engine such as used on a lawnmower.

It is also an object of the invention to provide a novel sound suppression system that creates additional turbulance within its sound suppression chamber thereby muffling the noise of the explosion created upon the firing of a bullet.

It is also an object of the invention to provide a novel sound suppression system that is economical to manufacture and easy to assemble.

It is an additional object of the invention to provide a novel sound suppression system that has a minimum number of parts.

It is a further object of the invention to provide a novel sound suppression system that has adjustable baffle structure.

SUMMARY OF THE INVENTION

The novel sound suppression system has a sound suppression chamber in the form of a longitudinally extending tubular housing and an end plug closes one end of the tubular housing and it has an aperture therein through-which passes a longitudinally extending tubular member.

The tubular member is formed from the barrel of a gun and it has a cylindrical sleeve pressed-fit on it and covering a substantial portion of its length. A plurality of gas passages extend longitudinally along the tubular member in the area where the outer surface of the gun barrel meets the inner surface of the cylindrical sleeve. One end of each of these gas passages turn radially inwardly until they are in communication with the bore of the gun barrel and the other end of these gas passages communicate with the interior of the tubular housing of the sound suppression chamber.

The end plug throughwhich passes the tubular member is press fit thereon and the end plug has a threaded shank portion that engages internal threads on the tubular housing. The internal threads in the tubular housing extend throughout the entire length and a baffle having a cylindrical body with external threads is threaded into the interior of the tubular housing. The baffle has a bore which is aligned with the bore of the gun barrel. The end of the baffle which faces the end of the gun barrel is a conical or convex gas deflection surface against which the gases exiting from the gas passages is directed. The other end of the baffle has a counter sunk hole and a pair of gripping fingers that aids in adjusting the baffle back and forth lengthwise through-out the threaded bore of the tubular housing.

The exit end of the tubular housing is closed by an end plug having a central bore which is also aligned with the axis of the bore of the gun barrel and it has a threaded shank which is threadably engaged with the threads on the interior of the tubular housing.

In operation as the bullet is fired, it will pass down the bore of the gun barrel and behind it will travel a wall or mass of gases having a high pressure. Just as the bullet is passing the inlets of the tubular gas passages, a portion of the gases behind the bullet senses an avenue of escape and they exit along the tubular gas passages and even accelerate from their previous speed. As a result of the increased speed of the gases passing through the gas passages, portions of the gas will exit the end of the gas passages into the tubular housing of the sound suppression chamber prior to the arrival of the bullet therein. This advance stream of gases are first directed against the conical or convex gas deflection surface of the baffle which causes a turblence resulting in a varity of paths through which the flow of gas will take as it twists and turns within that portion of the sound suppression chamber between the end of the barrel and the baffle. This turbulence affects the axial path that the gases traveling behind the bullet are taking and this disruption along with the effect of the disruption of the gases which travel through the gas passages produces a muffling of the sound that has been released by the explosion when the bullet was fired. After the axial path of the gases traveling through the bore of the gun barrel has been disrupted they eventually make their way through the bore of the baffle then pass through the remaining portion of the sound suppression chamber and eventually outwardly through the bore in the end plug. The thinness of the front wall of the baffle and the enlarged countersunk hole on its opposite side of the baffle prevents the gases passing through the bore of the baffle from organizing back into a controlled compact mass of gases traveling along an axial path. The enlarged countersunk hole on the exit side of the end plug performs in a manner similar to that of the enlarged countersunk hole of the baffle. The action of the turbulence in the area of the sound suppression chamber between the end of the gun barrel and the bore of the baffle acts to strip the wall or mass of compact gases away from the zone immediately behind the bullet as it travels along its path of travel. The additional turbulence created in the sound suppression chamber between the bore of the baffle and the bore of the end plug further acts to strip away any compact mass of gases that may have reformed behind the bullet as they pass through the bore of the baffle. An additional dispersion of the flow of gases occurs as they exit the bore of the end plug and the cummulative effect is to substantially eliminate the noise that normally occurs upon the firing of a bullet.

The degree of muffling of the sound can be varied by adjusting the baffle axially along the length of the tubular housing of the sound suppression chamber.

The novel sound suppression system can be utilized in a structure as a muffler for the gases of an internal combustion engine such as that used on a lawnmower or similar type of machines.

DESCRIPTION OF THE PREFERRED EMBODIMENT

Figure 1:
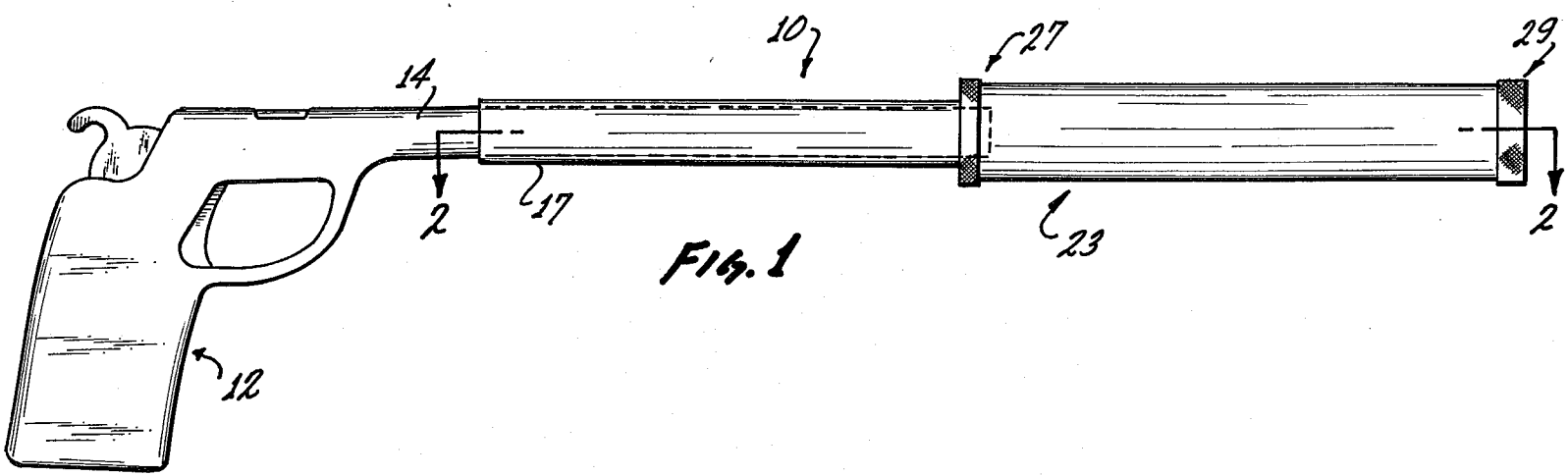
FIG. 1 is a side elevational view illustrating the sound suppression system installed on a revolver.
Figure 2:
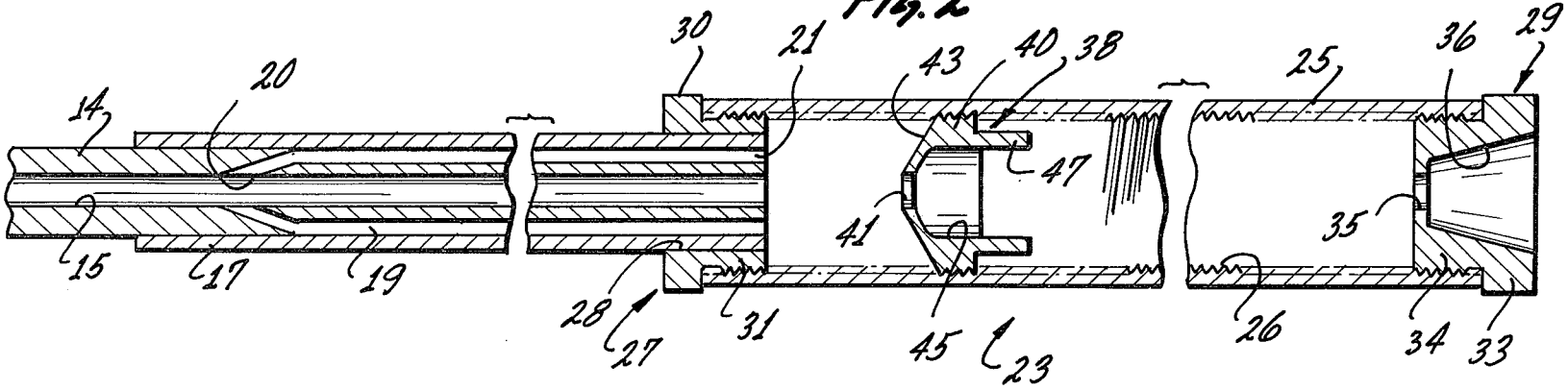
FIG. 2 is a cross-sectional view taken along lines 2—2 of FIG. 1.
Figure 3:
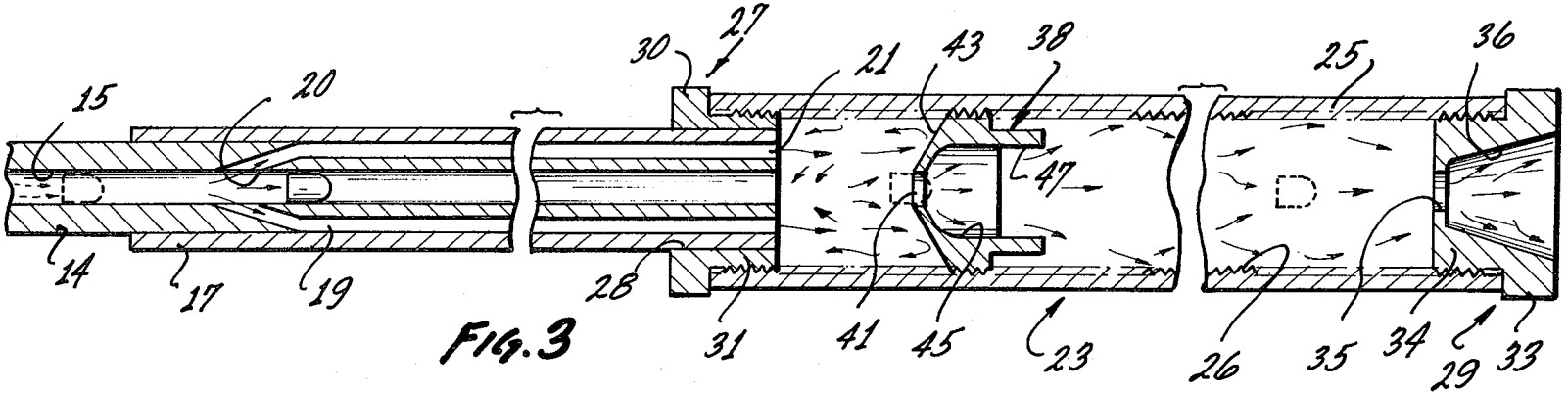
FIG. 3 is a schematic illustration of the novel sound suppression system showing the path taken by a bullet and also the paths taken by the gases as they travel through the bore of the gun barrel.

The novel sound suppression system will be described by referring to FIGS. 1–3. The sound suppression system is generally designated numeral 10 and it is attached to a revolver 12.

The revolver 12 has a gun barrel 14 having a bore 15. A cylindrical sleeve 17 surrounds the barrel 14 and it has a plurality of gun passages 19 each of which has inlet 20 and an outlet 21.

A sound suppression chamber 23 has a longitudinally extending tubular housing 25 closed at its ends by end plugs 27 and 29 respectively. End plug 27 has a bore 28 which receives one end of cylindrical sleeve 17. End plug 27 has a head 30 and a threaded shank 31 that is threadably received in the threaded bore 26 that extends the length of tubular housing 25.

End plug 29 has a head 33, a threaded shank 34, a central bore 35 and a counter sunk hole 36.

A baffle 38 has a cylindrical body that is externally threaded to mate with the threads on the interior of tubular housing 25. One end of baffle 38 has a bore 41 that is in alignment with the bore 15 of the gun barrel. Also on this end of baffle 38 is a conical or convex gas deflection surface 43. The opposite end of baffle 38 has a counter-sunk hole 45 and a plurality of gripping fingers 47.

Figure 4:
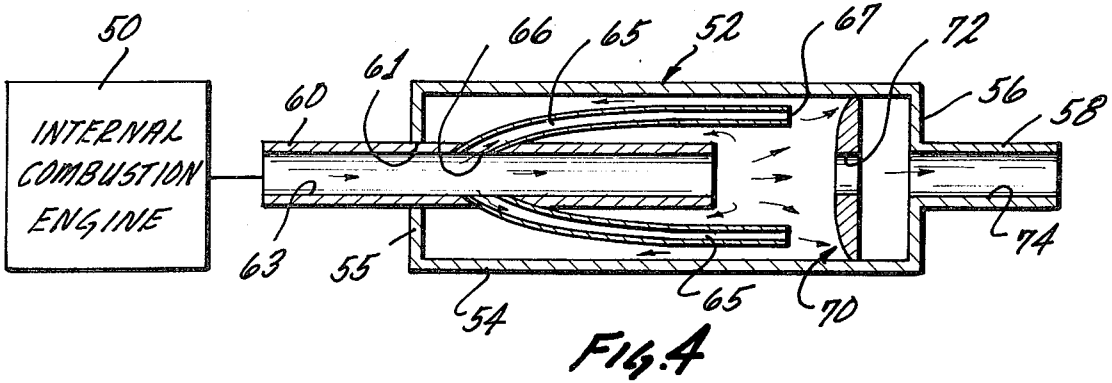
FIG. 4 is a schematic illustration of the novel sound suppression system used as a muffler in conjunction with an internal combustion engine.

An alternative application of the novel sound suppression system is illustrated in FIG. 4, where it is used in conjunction with an internal combustion engine 50. The sound suppression chamber is designated numeral 52 and it has a tubular housing 54, end walls 55 and 56, and a tubular exhaust member 58.

A tubular member or pipe 60 has a portion of its length passing through a bore or aperture 61 in end wall 55. Exhaust gasesfrom the internal combustion engine 50 pass through the bore 63 of tubular member 60 with part of the gases continuing axially and another portion of the gases traveling through tubular passages 65. These tubular passages have an air inlet 66 and an air outlet 67.

As the gases exit outlet 67 they are directed against a baffle 70 having a bore 72. These gases that have first bounced off the baffle 70 create a turbulence among themselves and also among the gases which have been traveling down the axial path along bore 63. The interaction of these gases creating a disruption of the axial flow results in a suppression of the noise level of the sound which will exit through the bore 74 of the tubular exhaust member 58.

Figure 5:
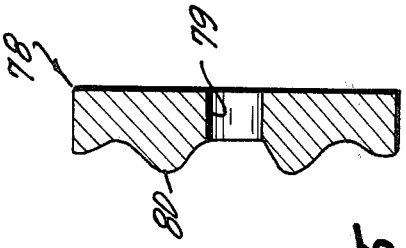
FIG. 5 is a cross sectional elevation view of an alternative baffle for the embodiment illustrated in FIG. 4.

An alternative structure for a baffle is illustrated in FIG. 5 and the baffle is designated 78 and has the bore 79. It has a rough contoured surface 80 which causes disruption in the flow path of the gases that are directed against this surface.

What is claimed is:

1. A sound suppression system for firearms comprising:

a sound suppression chamber having a longitudinally extending tubular housing with a first end and an opposite second end, a first wall structure closes said first end and it has an aperture therein through which passes a longitudinally extending tubular member;

baffle means are positioned within the interior of said tubular housing;

said tubular member having a plurality of gas passage means whose first ends connect with the bore of said tubular member and which pass longitudinally along the length of said tubular member in the area of the tubular between its bore and its outer diameter and whose opposite second ends exit from the front end of the tubular member directly into said sound suppression chamber adjacent one face of said baffle means whereby said gases under a high pressure and traveling at a high speed are directed to said sound suppression chamber through said tubular member, a portion of said gases upon reaching the first end of said gas passage means will enter these gas passage means and accelerate their speed of travel, relative to that remaining portion of gases continuing along the axial bore of said tubular member, so that they exit from the second end of said tubular passage means and are directed against said baffle means prior to the arrival of the remaining portion of the gases that had continued along the axial bore of said tubular member; and said bore and said gas passages being free of any valves that might function to close any of these passages during the operation of said sound suppression system.

2. A sound suppression system as recited in claim 1 wherein said first wall structure is an end plug having a threaded shank.

3. A sound suppression system as recited in claim 1 wherein said tubular housing has an internally threaded bore throughout its length.

4. A sound suppression system as recited in claim 3 further comprising an end plug having a threaded shank that is removeably received in said second end of said tubular housing.

5. A sound suppression system as recited in claim 3 wherein said baffle means has a cylindrical body that is externally threaded along its outer longitudinal surface, said body having a bore in its center axial area and a first end surface that is conical and its opposite end surface has a countersunk hole.

6. A sound suppression system as recited in claim 1 wherein said tubular member comprises a gun barrel having a cylindrical sleeve surrounding a predetermined length of said gun barrel.

7. A sound suppression system as recited in claim 6 wherein said gas passage means comprises grooves formed in the outer surface of said gun barrel with their radial open surfaces being covered by the inner diameter of said cylindrical sleeve.

* * * * *